US007717836B1

(12) United States Patent
Miller et al.

(10) Patent No.: US 7,717,836 B1
(45) Date of Patent: May 18, 2010

(54) EXERCISE APPARATUS WITH SEAT STOW-AWAY SYSTEM

(75) Inventors: Aaron J. Miller, Brooklyn Center, MN (US); Thor S. Swanson, Bensenville, IL (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/748,526

(22) Filed: May 15, 2007

(51) Int. Cl.
*A63B 26/00* (2006.01)

(52) U.S. Cl. ..... 482/142

(58) Field of Classification Search ..... 482/51, 482/92–94, 98–103, 133–138, 142, 908; 297/14, 331, 334, 335; *A63B 26/00*
See application file for complete search history.

(56) References Cited

U.S. PATENT DOCUMENTS 1,395,757 A * 11/1921 McWhirter ..... 297/334
1,914,069 A * 6/1933 Blakelock ..... 297/256
4,804,179 A * 2/1989 Murphy et al. ..... 482/97
4,936,572 A * 6/1990 Desiderio ..... 482/142
6,508,748 B1 * 1/2003 Ish, III ..... 482/100
6,605,023 B1 * 8/2003 Mobley ..... 482/142
7,331,912 B2 * 2/2008 Keiser et al. ..... 482/142
2003/0050157 A1 * 3/2003 Teuscher ..... 482/142
2006/0035772 A1 * 2/2006 Golesh et al. ..... 482/142
2006/0040810 A1 * 2/2006 Chu ..... 482/142

* cited by examiner

*Primary Examiner*—Loan H Thanh
*Assistant Examiner*—Oren Ginsberg
(74) *Attorney, Agent, or Firm*—Andrus, Sceales, Starke & Sawall, LLP

(57) ABSTRACT

Exercise apparatus is provided with a system for collapsing a user seat to a stow-away position. A user-engaged locking device releasably locks a bearing assembly and a seat frame at each of a user-exercise position and a stow-away position.

16 Claims, 11 Drawing Sheets

FIG. 10
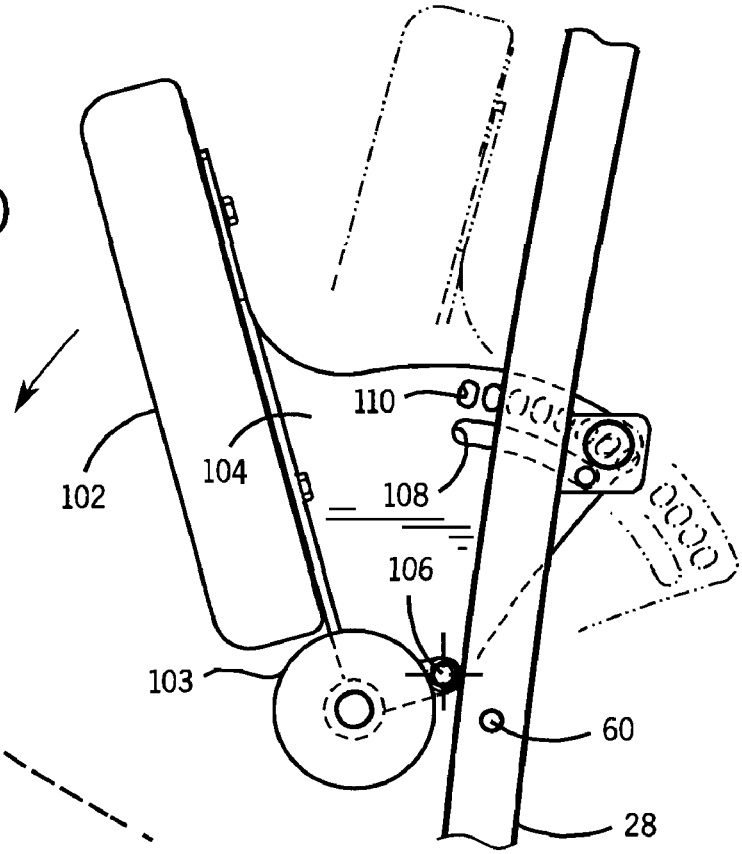
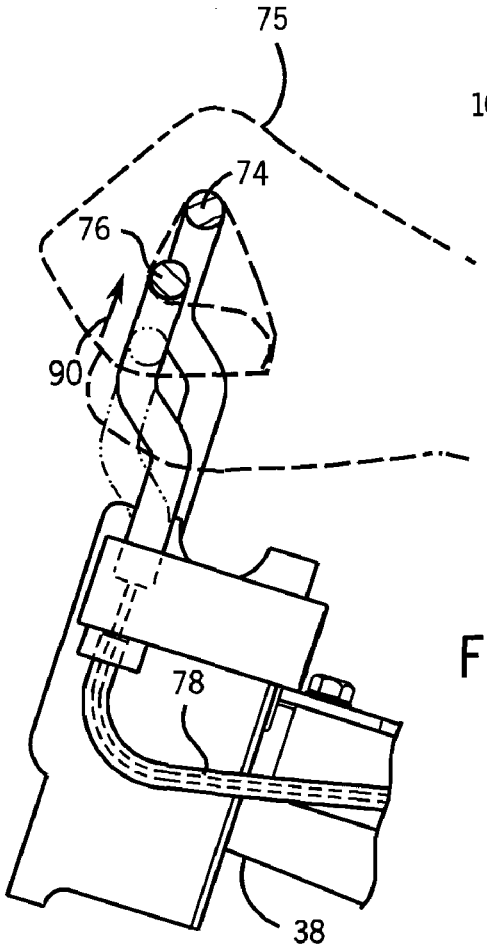
FIG. 12

EXERCISE APPARATUS WITH SEAT STOW-AWAY SYSTEM

BACKGROUND AND SUMMARY

The invention relates to exercise apparatus, and more particularly a seat stow-away system.

Exercise apparatus typically includes a support frame including a support base resting on a floor and a support post extending upwardly therefrom and supporting a user seat upon which the user sits during an exercise routine, e.g. weight/resistance training, etc. The present invention arose during continuing development efforts directed toward such apparatus, and provides a simple and efficient seat stow-away system.

BRIEF DESCRIPTION OF THE DRAWINGS

FIG. 10 is an enlarged view of a portion of FIG. 5.

FIG. 12 is an enlarged view of a portion of FIG. 11.

DETAILED DESCRIPTION

Figure 1:
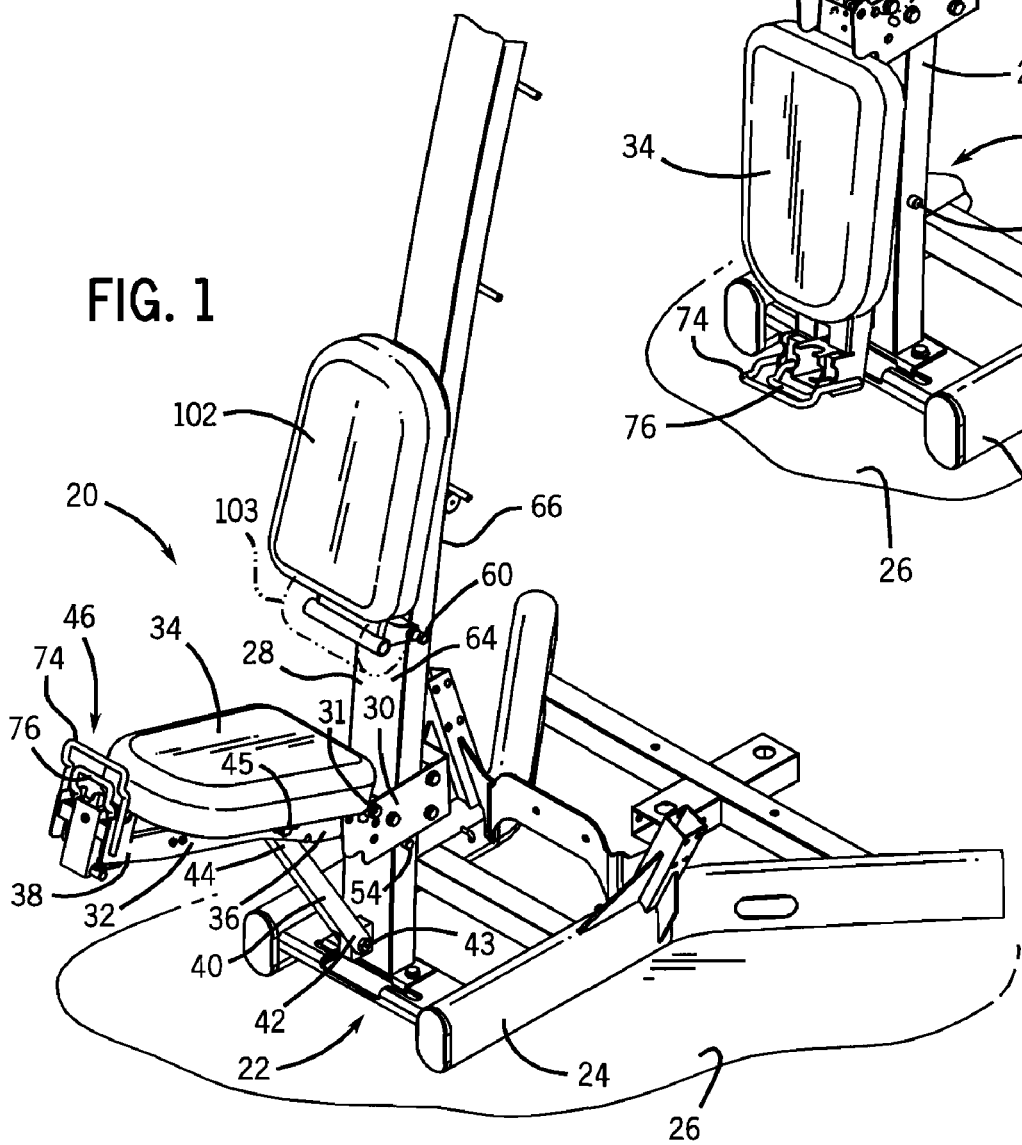
FIG. 1 is a perspective view of exercise apparatus in accordance with the invention, including a seat in a user-exercise position.
Figure 3:
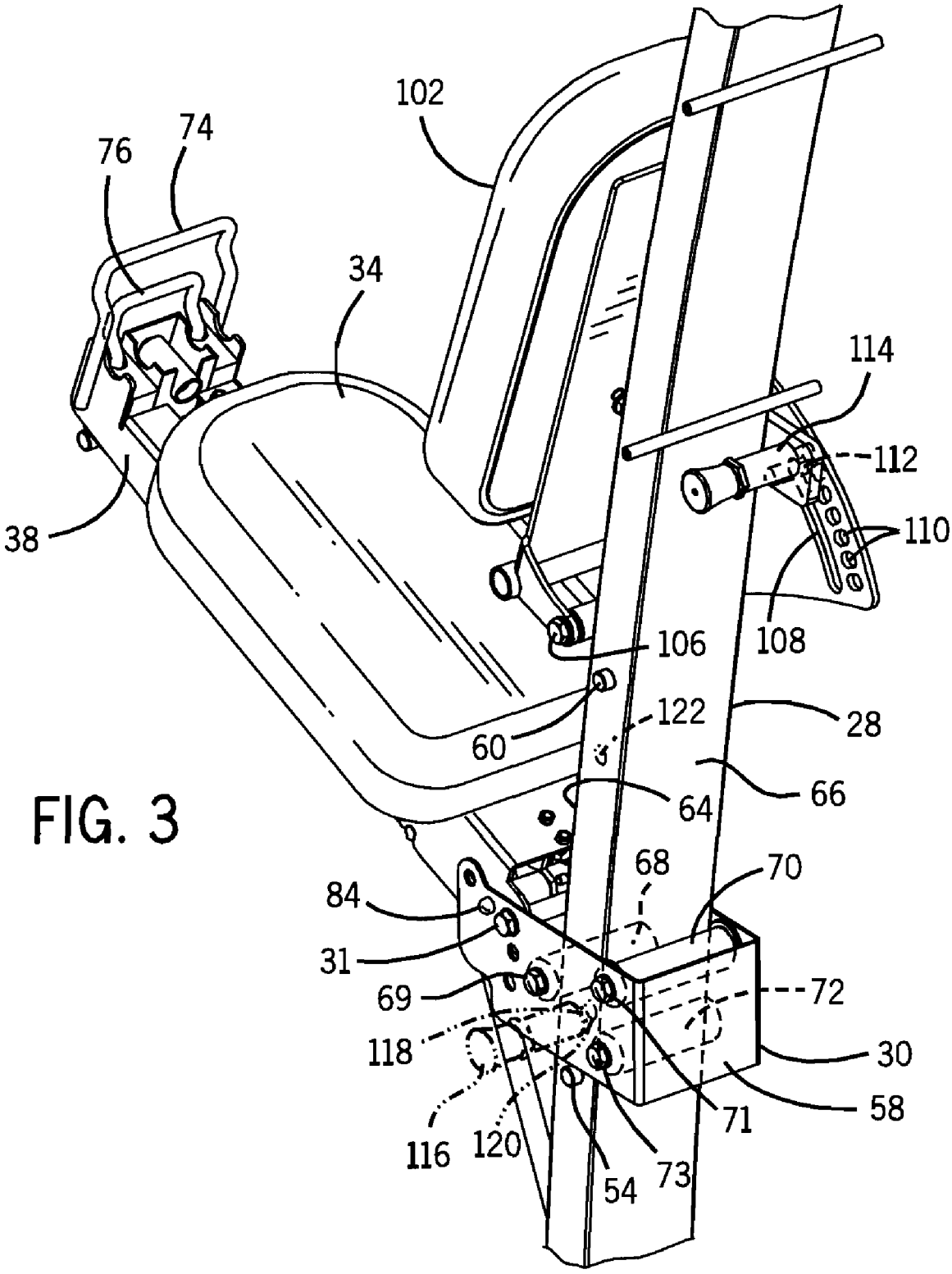
FIG. 3 is a perspective view of the apparatus of FIG. 1 from a different angle.

FIG. 1 shows exercise apparatus 20 having a support frame 22 including a support base 24 resting on a floor 26 and a support post 28 extending upwardly therefrom. A bearing assembly 30 is movable upwardly and downwardly along support post 28 to a plurality of positions including a user-exercise position, FIG. 1, and a stow-away position, FIG. 2. The stow-away position of bearing assembly 30 is spaced above the user-exercise position of the bearing assembly. A seat frame 32 has a user seat 34 thereon and extends between a root end 36 and a free end 38. Root end 36 is pivotally mounted to bearing assembly 30 at axle bolt 31 and moves upwardly and downwardly therewith along support post 28 including between the noted user-exercise position and the noted stow-away position. A connector link 40 has a first end 42 pivotally connected at bolt 43 to support frame 22 at a location below bearing assembly 30, and has a second end 44 pivotally connected at bolt 45 to seat frame 32 at a location between root end 36 and free end 38.

Figure 6:
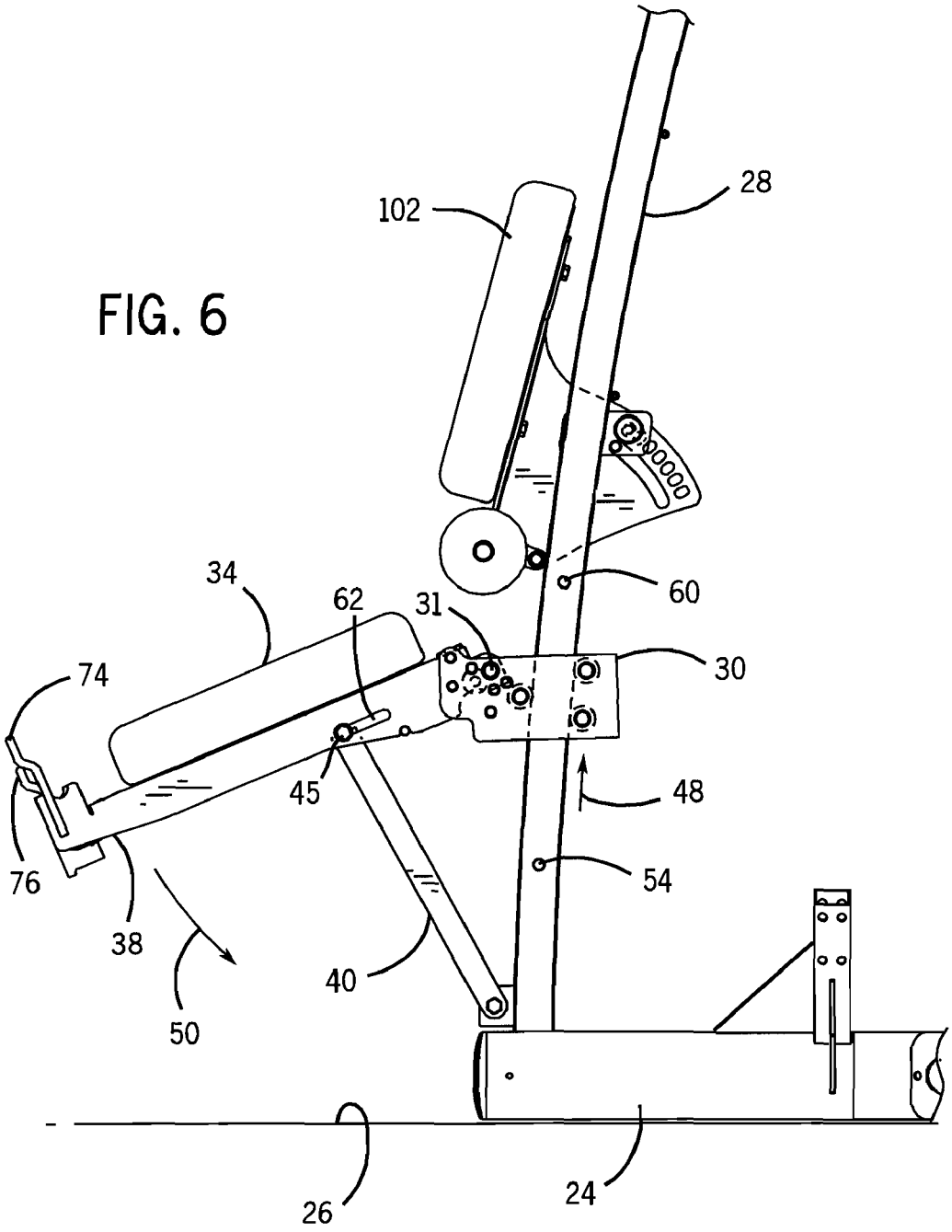
FIG. 6 is like FIG. 5 and shows the seat in a partially collapsed position.
Figure 7:
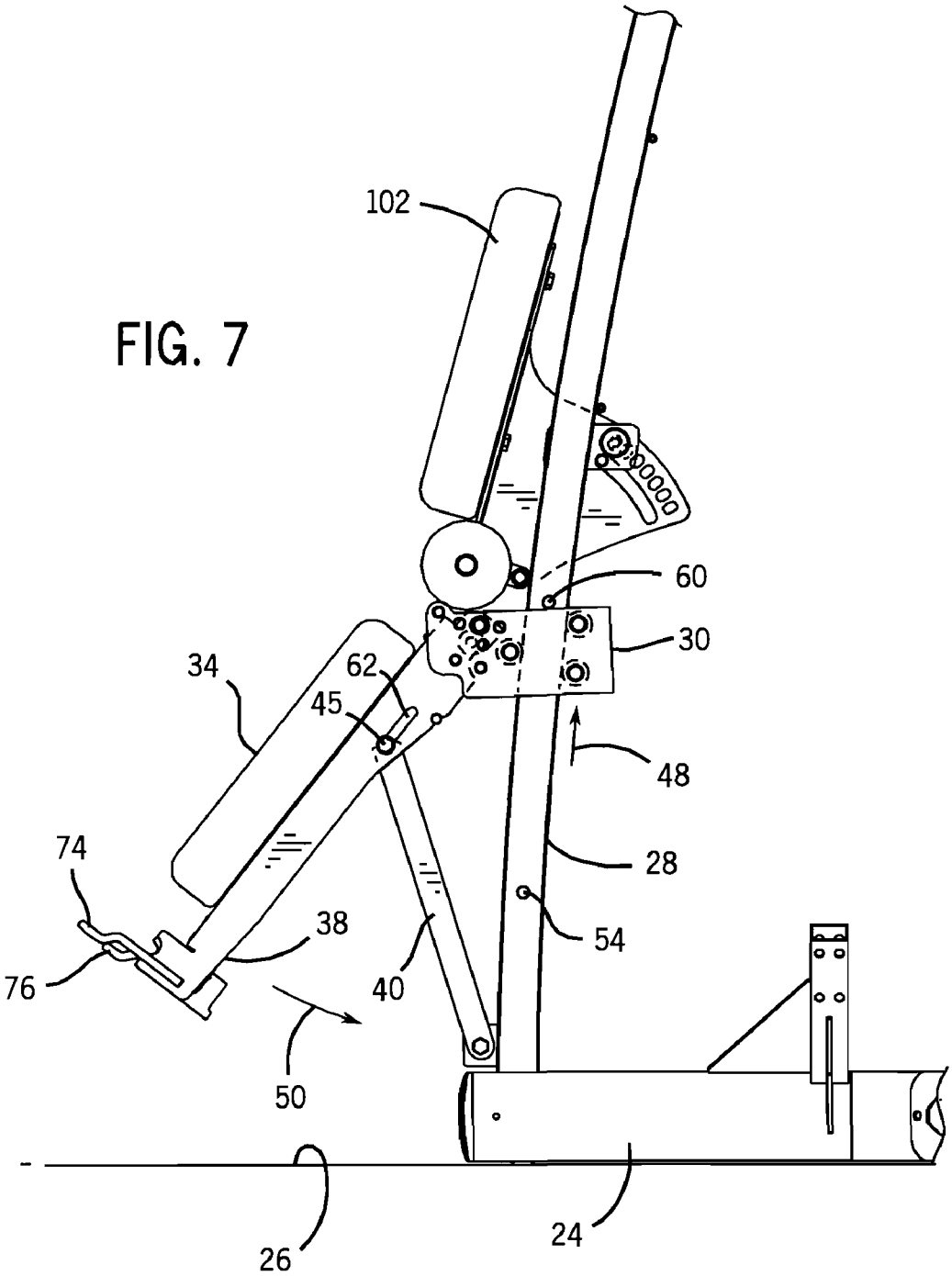
FIG. 7 is like FIG. 6 and shows the seat in a further collapsed position.

A user-engaged locking device 46, FIG. 1, releasably locks bearing assembly 30 at each of the noted user-exercise position and stow-away position and prevents upward and downward movement of bearing assembly 30 along support post 28. Bearing assembly 30 moves upwardly as shown at arrow 48 in FIGS. 6-8 along support post 28 from the user-exercise position of FIG. 5 to the stow-away position of FIG. 8 when free end 38 of seat frame 32 is swung downwardly in an arc 50 about root end 36. In the stow-away position, FIGS. 2, 8, seat frame 32 extends along support post 28 and generally parallel thereto.

Figure 4:
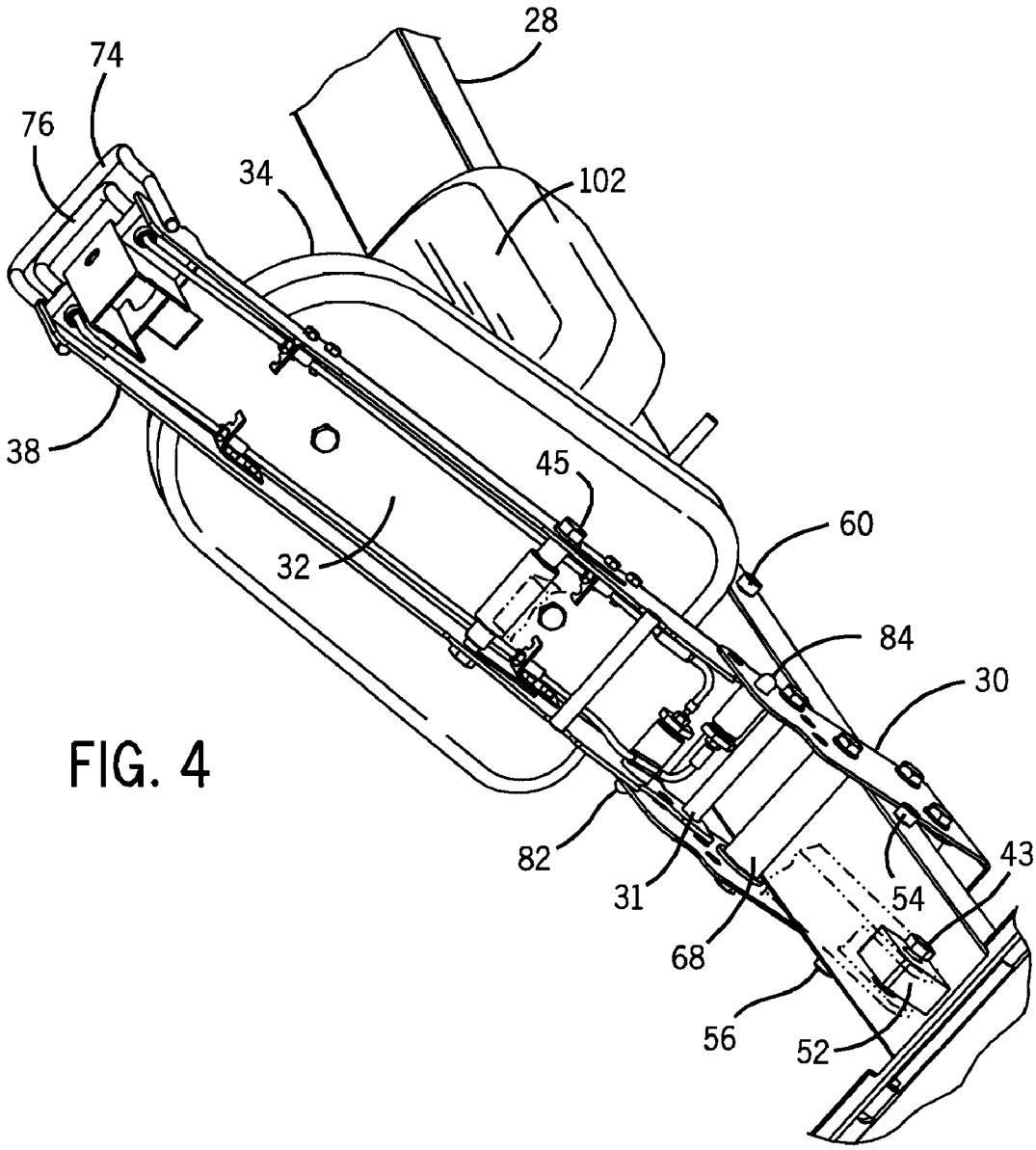
FIG. 4 is a perspective view from below of the apparatus of FIG. 1.

User-engaged locking device 46 releasably locks bearing assembly 30 to root end 36 of seat frame 32 to prevent pivoting of root end 36 about bearing assembly 30 to prevent a change in angle between seat frame 32 and support post 28. Connector link 40 triangulates between support post 28 and seat frame 32 to form a triangle therewith. The angle between seat frame 32 and support post 28 is an included angle in the noted triangle such that the prevention of a change in such included angle prevents upward and downward movement of bearing assembly 30 along support post 28. First end 42 of connector link 40 is pivotally mounted to support post 28, preferably at a reinforced subpost 52, FIGS. 4, 5, adjacent support base 24. Support post 28 may include lower bosses 54, 56, FIGS. 4, 5, extending laterally from laterally opposite sides thereof for providing a lower stop against downward movement of cage 58 of bearing assembly 30 and/or to provide additional support for the bearing assembly and seat frame in the noted user-exercise position, FIGS. 1, 3-5. Support post 28 may also have upper bosses such as 60 extending laterally therefrom to stop upward movement of cage 58 of bearing assembly 30 if desired. If vertical height constraints are such that seat frame 32 is not fully collapsed, FIG. 7, when bearing assembly cage 58 is stopped against stop 60, or if it is desired to otherwise limit the vertical travel of bearing assembly cage 58, then seat frame 32 is provided with a lost motion slot 62 in which the noted second end 44 of connector link is pivotally mounted and along which end 44 at axle bolt 45 may translationally slide to the position of FIG. 8 while bearing assembly cage 58 is stopped against stop 60, to enable full collapse of seat frame 32 to the position of FIG. 8.

Figure 5:
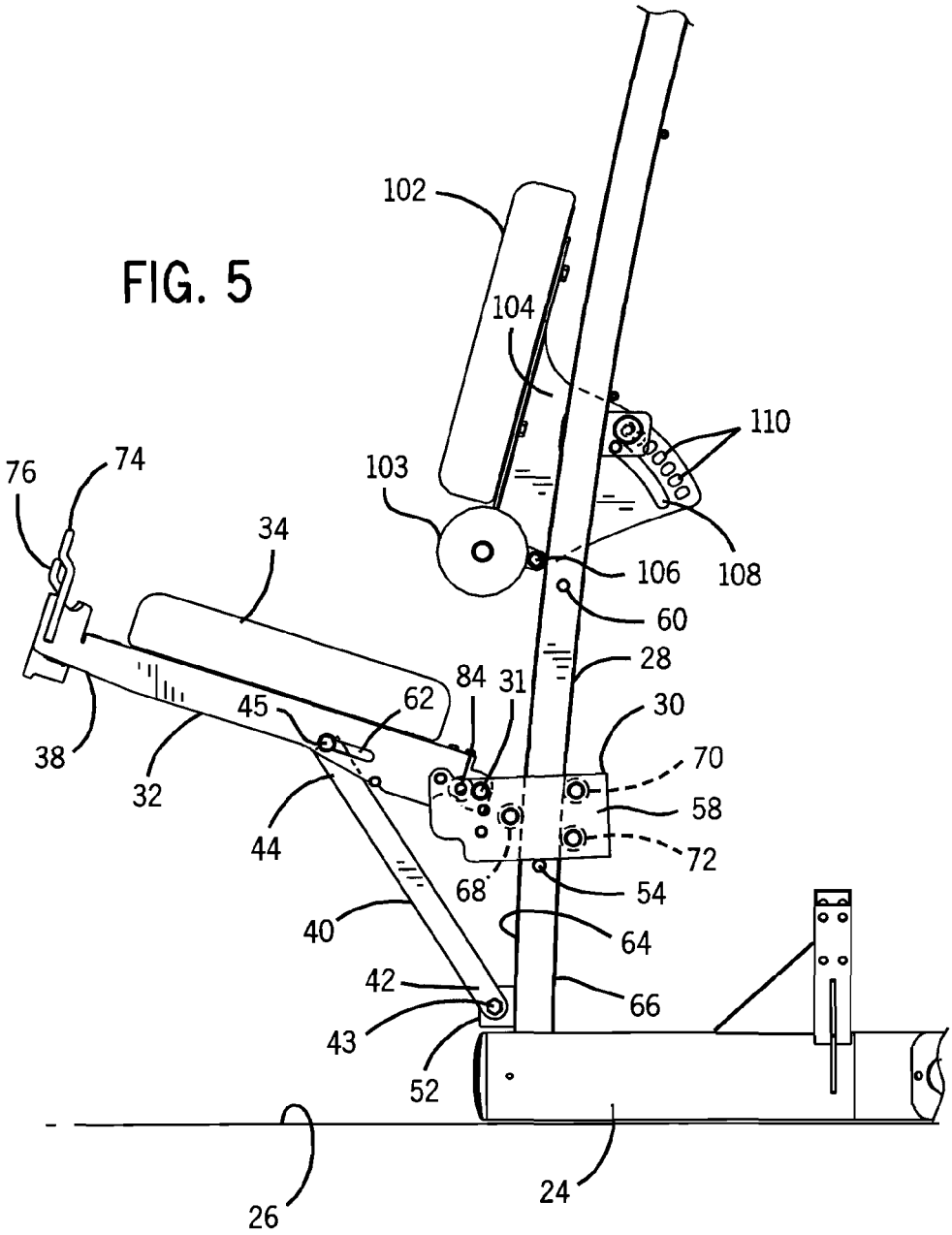
FIG. 5 is a side elevation view of the apparatus of FIG. 1.

Support post 28 has a front side 64, FIGS. 1, 5, facing forwardly toward user seat 34, and a distally opposite rear side 66 facing rearwardly. Bearing assembly 30 includes the noted cage 58 which is a U-shaped member opening forwardly and having a first bearing 68, FIGS. 3-5, 11, 14, engaging front side 64 of support post 28, and second and third bearings 70 and 72 engaging rear side 66 of support post 28. Each of the bearings is preferably a roller journaled on a respective bolt 69, 71, 73, and rolling along the respective side of the support post during upward and downward movement of bearing assembly 30.

Figure 13:
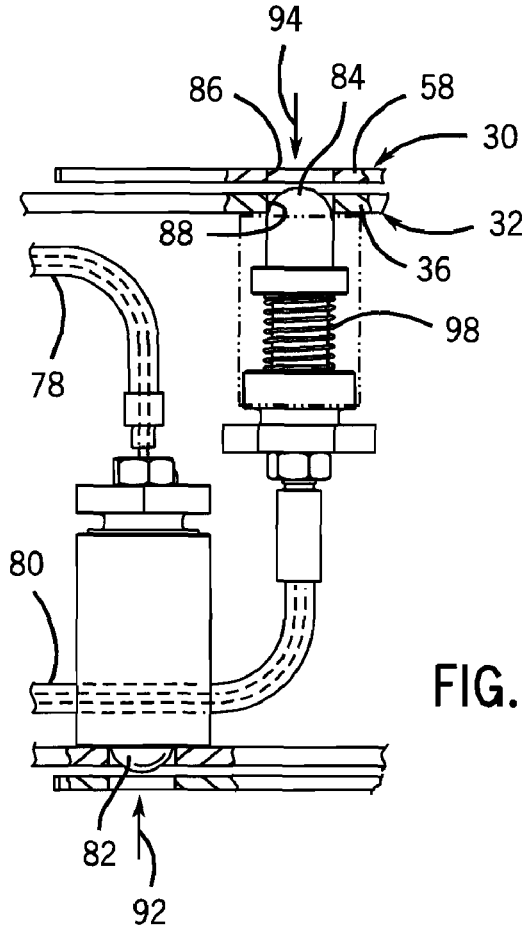
FIG. 13 is an enlarged view of a portion of FIG. 9.
Figure 14:
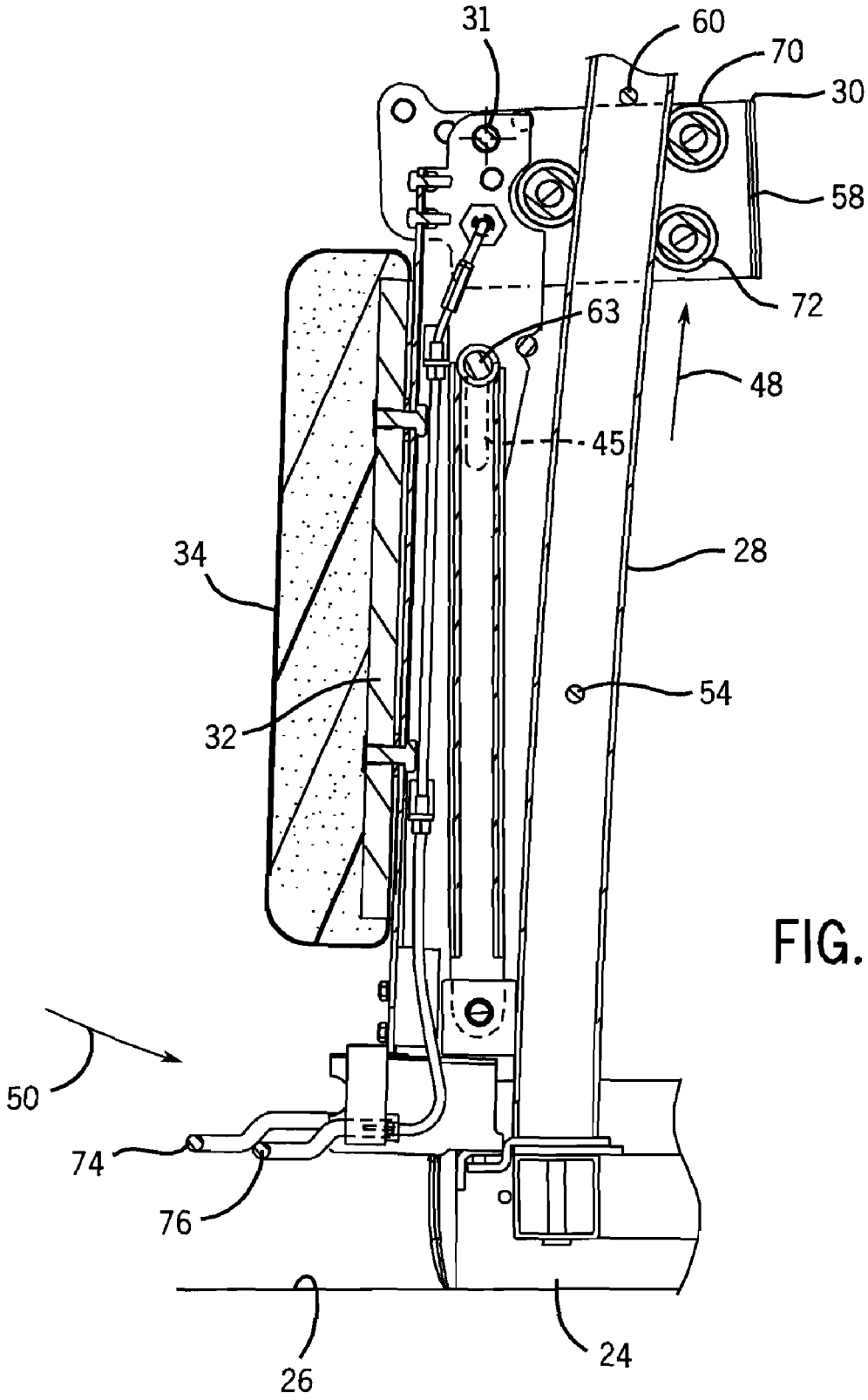
FIG. 14 is an enlarged view of a portion of FIG. 8 in section.

First and second handles 74 and 76, FIGS. 1-5, are provided at free end 38 of seat frame 32. First handle 74 is fixedly mounted to and is stationary relative to seat frame 32 and is user-engageable to swing free end 38 of the seat frame downwardly along arc 50, moving bearing assembly 30 from the user-exercise position of FIGS. 1, 5, to the stow-away position of FIGS. 2, 8. Second handle 76 is part of the user-engaged locking device 46 and is movable relative to seat frame 32 and is operatively coupled, preferably by one or more cables 78, 80, FIGS. 4, 9, 11-14, to one or more movable locking pins such as 82 and 84, respectively, to move a respective pin between locking and unlocking positions respectively preventing and permitting movement of seat frame 32 along arc 50 and movement of bearing assembly 30 along support post 28 between the noted user-exercise and stow-away positions, FIGS. 1 and 2, respectively. In the locking position, the respective locking pin extends between and engages each of seat frame 32 and bearing assembly 30. In the preferred embodiment, the respective locking pin in the locking position extends through aligned apertures 86 and 88, FIG. 13, in cage 58 of bearing assembly 30 and root end 36 of seat frame 32. FIG. 13 shows locking pins 82 and 84 in their unlocking positions. Second handle 76 is movable toward first handle 74 as shown at arrow 90 in FIG. 12, to pull cables 78 and 80 to in turn pull respective locking pins 82 and 84 inwardly as shown at respective arrows 92 and 94 in FIG. 13, to in turn retract pins 82 and 84 out of respective apertures 86 and 94, to in turn release seat frame 32 and bearing assembly 30 for pivotal movement relative to each other about pivot axle bolt 31. Handle 76 is sufficiently proximate to handle 74 to enable gripping of both handles with a single hand 75, FIG. 12, of the user, to enable release of seat frame 32 for movement to the stow-away position, FIGS. 2, 8, by the user gripping both handles 74 and 76 in a single hand and pulling second handle 76 towards first handle 74, and then swinging free end 38 of the seat frame downwardly along arc 50, FIGS. 6-8. Locking pins 82, 84 are preferably biased, e.g. by a respective spring such as 98, FIG. 13, to a locking position extending into respective apertures 86 and 88, such that upon release of handle 76 the locking device defaults to a normally locked position.

The exercise apparatus includes a back rest 102 on a frame 104 pivotally mounted to support post 28 at pivot rod 106 and adjustable at slot 108 between a plurality of arcuate positions as determined by apertures 110 receiving a retractable pin 112 of spring biased pull pin assembly 114. An additional back rest roll pad may be provided if desired at 103.

Figure 2:
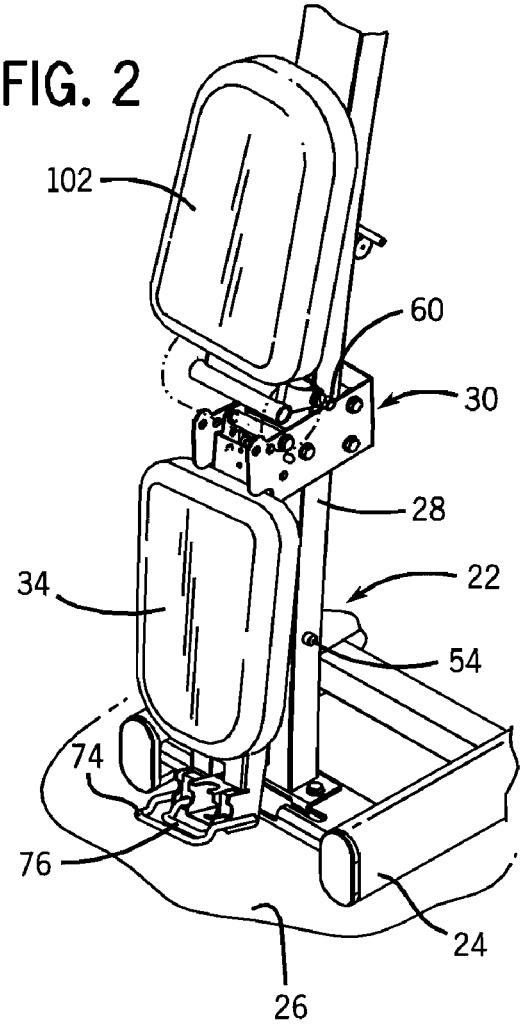
FIG. 2 shows a portion of FIG. 1, with the seat in a stow-away position.
Figure 8:
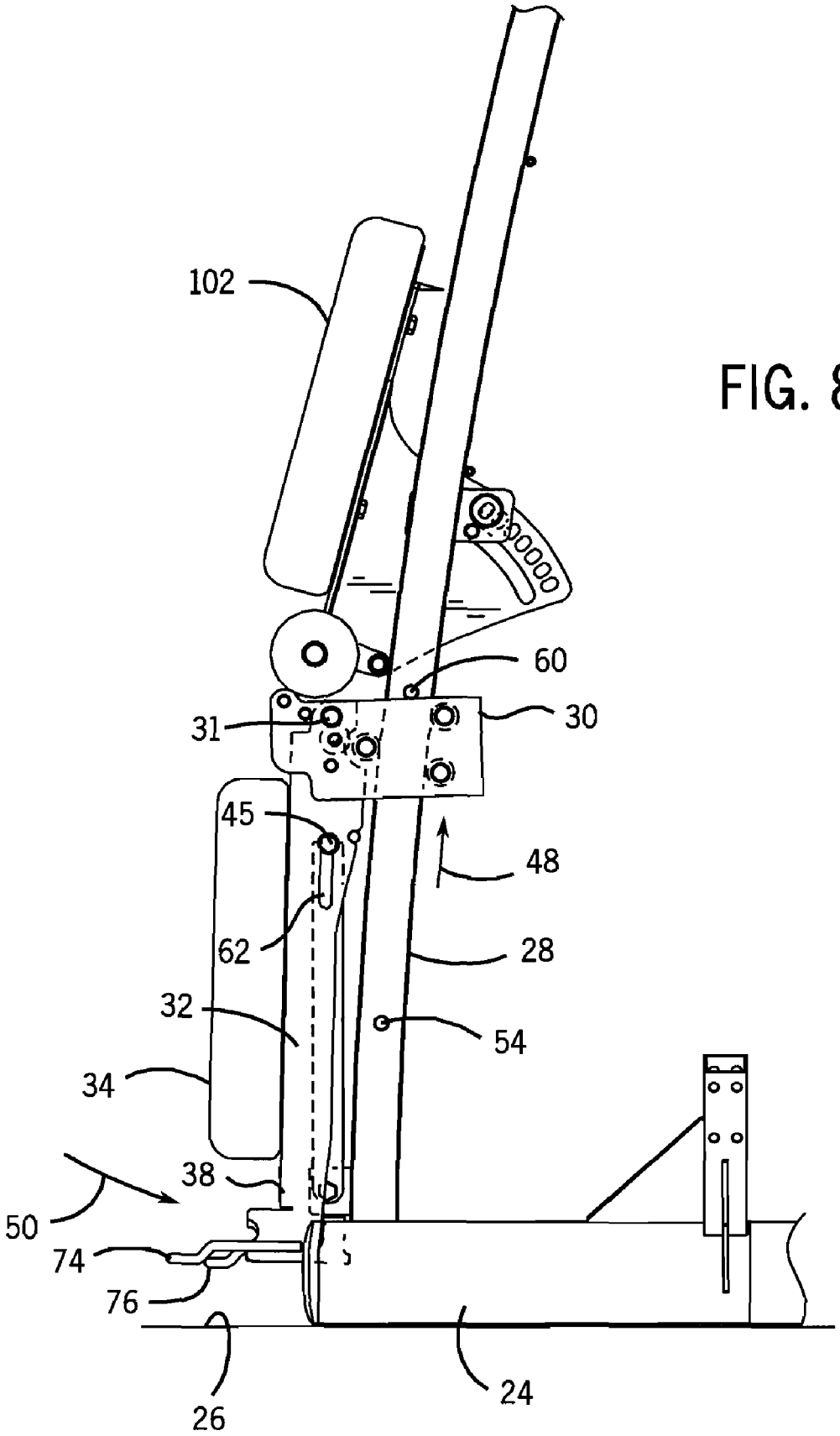
FIG. 8 is like FIG. 7 and shows the seat in a fully collapsed stow-away position.
Figure 9:
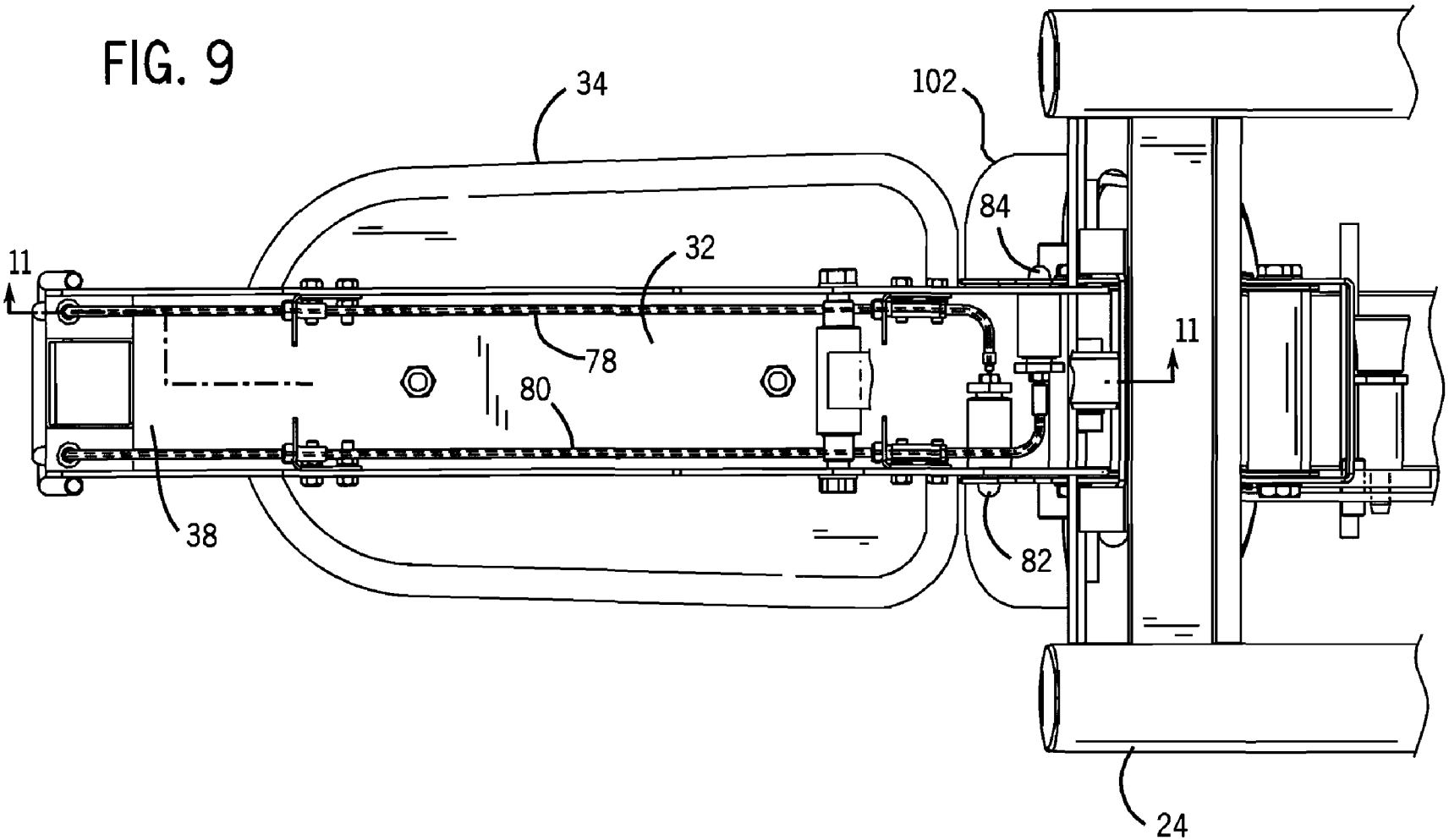
FIG. 9 is an elevation view from below of the apparatus of FIG. 5.
Figure 11:
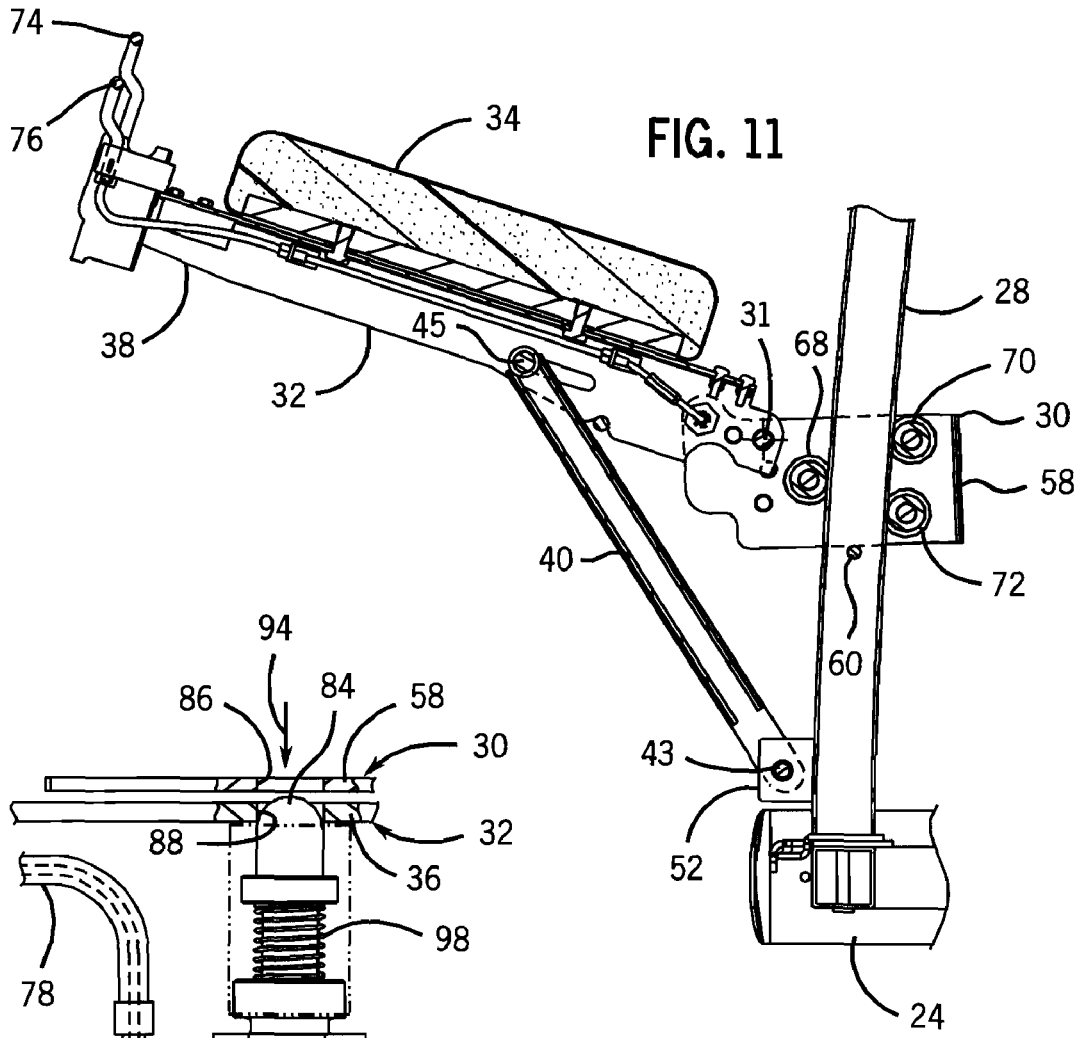
FIG. 11 is a sectional view taken along line 11-11 of FIG. 9.

The system provides a method for stowing exercise apparatus 20 having a support frame 22 including a support base 24 resting on a floor 26 and a support post 28 extending upwardly therefrom, and a bearing assembly 30 movable upwardly and downwardly along support post 28 to a plurality of positions including a user-exercise position, FIGS. 1, 5, and a stow-away position, FIGS. 2, 8. The stow-away position of bearing assembly 30 is spaced above the user-exercise position of the bearing assembly. A seat frame 32 has a user seat 34 thereon and extends between a root end 36 and a free end 38, with the root end being pivotally mounted at pivot axle 31 to bearing assembly 30 and movable therewith upwardly and downwardly along support post 28 between the user-exercise position and the stow-away position. Connector link 40 has the noted first end 42 pivotally connected to the support frame at a location below bearing assembly 30, and has the noted second end 44 pivotally connected to seat frame 32 at a location between root end 36 and free end 38. User-engaged locking device 46 releasably locks bearing assembly 30 at each of the user-exercise position and the stow-away position and prevents upward and downward movement of bearing assembly along support post 28. The method involves simply releasing the bearing assembly with the user-engaged locking device, and moving the bearing assembly from the user-exercise position to the stow-away position. The method is preferably accomplished by swinging free end 38 of seat frame 32 downwardly in an arc 50, to in turn cause movement of bearing assembly 30 from the user-exercise position to the stow-away position. The method further preferably involves releasing the seat frame for movement to the stow-away position by gripping both handles 74 and 76 in a single hand 75 and pulling second handle 76 toward first handle 74.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. For example, in one alternative a user-engaged locking device may releasably lock bearing assembly 30 to support post 28 to prevent the noted upward and downward movement of the bearing assembly along the support post, for example a biased locking pin assembly as shown in dashed line at 116 in FIG. 3 mounted on cage 58 of bearing assembly 30 and having a pin 118 insertable into an aperture 120 in support post 28 to lock the bearing assembly in its lower position corresponding to the user-exercise position of FIGS. 1, 5, and insertable into aperture 122 in support post 28 to lock the bearing assembly in its upper position corresponding to the seat stow-away position of FIGS. 2, 8.

What is claimed is:

1. Exercise apparatus comprising a support frame comprising a support base resting on a horizontal floor and a support post extending upwardly therefrom, a bearing assembly movable upwardly and downwardly along said support post to a plurality of positions vertically spaced above said floor, said positions of said bearing assembly being vertically spaced from each other and including a user-exercise position and a stow-away position, said stow-away position of said bearing assembly being spaced above said user-exercise position of said bearing assembly, namely said bearing assembly in said stow-away position along said support post being at a higher vertical elevation with respect to said floor than said bearing assembly in said user-exercise position along said support post, a seat frame having a user seat thereon and extending between a root end and a free end, said root end being pivotally mounted to said bearing assembly and movable therewith upwardly and downwardly along said support post including between said user-exercise position and said stow-away position, a connector link having a first end pivotally connected to said support frame at a location below said bearing assembly, and having a second end pivotally connected to said seat frame at a location between said root end and said free end, wherein said free end of said seat frame swings downwardly in an arc about said root end and said bearing assembly moves upwardly along said support post, to change from said user-exercise position to said stow-away position, a user-engaged locking device releasably locking said bearing assembly at each of said user-exercise position and said stow-away position and preventing upward and downward movement of said bearing assembly along said support post, said user-engaged locking device comprises a movable handle at said free end of said seat frame and operatively coupled to a movable locking pin to move said pin between locking and unlocking positions respectively preventing and permitting said movement of said bearing assembly along said support post between said user-exercise and stow-away positions, wherein said locking pin in said locking position extends between and engages each of said seat frame and said bearing assembly, wherein said locking pin in said locking position extends through aligned apertures in said bearing assembly and said root end of said seat frame.

2. The exercise apparatus according to claim 1 wherein said bearing assembly moves upwardly along said support post from said user-exercise position to said stow-away position when said free end of said seat frame is swung downwardly in an arc about said root end.

3. The exercise apparatus according to claim 2 wherein said seat frame extends along said support post and generally parallel thereto in said stow-away position.

4. The exercise apparatus according to claim 1 wherein said user-engaged locking device releasably locks said bearing assembly to said root end of said seat frame to prevent pivoting of said root end about said bearing assembly to prevent a change in angle between said seat frame and said support post.

5. The exercise apparatus according to claim 4 wherein said connector link triangulates between said support post and said seat frame to form a triangle therewith, said angle between said seat frame and said support post being an included angle in said triangle such that the prevention of a change in said angle prevents upward and downward movement of said bearing assembly along said support post.

6. The exercise apparatus according to claim 5 wherein said first end of said connector link is pivotally mounted to said support post.

7. The exercise apparatus according to claim 6 wherein said support post comprises a reinforced subpost adjacent said support base, and wherein said first end of said connector link is pivotally connected to said reinforced subpost.

8. The exercise apparatus according to claim 5 wherein said support post has one or more bosses extending therefrom and limiting at least one of the upward and downward movement of said bearing assembly along said support post.

9. The exercise apparatus according to claim 8 wherein said one or more bosses limit upward movement of said bearing assembly, and wherein said second end of said connector link is pivotally connected to said seat at a lost motion slot.

10. The exercise apparatus according to claim 9 wherein said bearing assembly moves upwardly along said support post from said user-exercise position to said stow-away position when said free end of said seat frame is swung downwardly in an arc about said root end, and wherein said second end of said connector link translates along said lost motion slot when said one or more bosses stops upward movement of said bearing assembly, to enable continued downward swinging of said free end of said seat frame in said arc to said stow-away position.

11. The exercise apparatus according to claim 1 wherein:

said support post has a front side facing forwardly toward said user seat, and a distally opposite rear side facing rearwardly; and said bearing assembly comprises a first bearing engaging said front side of said support post, and a second bearing engaging said rear side of said support post.

12. The exercise apparatus according to claim 11 wherein:

said first bearing comprises a first roller rolling along said front side of said support post during said upward and downward movement of said bearing assembly;

said second bearing comprises a second roller rolling along said rear side of said support post during said upward and downward movement of said bearing assembly;

and comprising a third bearing engaging said rear side of said support post, said third bearing comprising a third roller spaced below said second roller and rolling along said rear side of said support post during upward and downward movement of said bearing assembly.

13. The exercise apparatus according to claim 1 comprising first and second handles at said free end of said seat frame, said first handle being user-engageable to swing said free end of said seat frame downwardly in an arc, moving said bearing assembly from said user-exercise position to said stow-away position, said second handle being part of said user-engaged locking device and movable relative to said seat frame and operatively coupled to a movable locking pin to move said pin between locking and unlocking positions respectively preventing and permitting said movement of said bearing assembly along said support post between said user-exercise and stow-away positions.

14. The exercise apparatus according to claim 13 wherein said first handle is stationary relative to said seat frame, and said second handle is movable toward said first handle and is sufficiently proximate thereto as to enable gripping of both said first and second handles with a single hand of the user, to enable release of said seat frame for movement to said stow-away position by the user gripping both said handles in a single hand and pulling said second handle toward said first handle.

15. The exercise apparatus according to claim 1 wherein said user-engaged locking device releasably locks said bearing assembly to said support post to prevent said upward and downward movement of said bearing assembly along said support post.

16. A method for stowing exercise apparatus having a support frame comprising a support base resting on a horizontal floor and a support post extending upwardly therefrom, a bearing assembly movable upwardly and downwardly along said support post to a plurality of positions vertically spaced above said floor, said positions of said bearing assembly being vertically spaced from each other and including a user-exercise position and a stow-away position, said stow-away position of said bearing assembly being spaced above said user-exercise position of said bearing assembly, namely said bearing assembly in said stow-away position along said support post being at a higher vertical elevation with respect to said floor than said bearing assembly in said user-exercise position along said support post, a seat frame having a user seat thereon and extending between a root end and a free end, said root end being pivotally mounted to said bearing assembly and movable therewith upwardly and downwardly along said support post including between said user-exercise position and said stow-away position, a connector link having a first end pivotally connected to said support frame at a location below said bearing assembly, and having a second end pivotally connected to said seat frame at a location between said root end and said free end, and a user-engaged locking device releasably locking said bearing assembly at each of said user-exercise position and said stow-away position and preventing upward and downward movement of said bearing assembly along said support post, said method comprising releasing said bearing assembly with said user-engaged locking device, and moving said bearing assembly from said user-exercise position to said stow-away position, wherein said free end of said seat frame swings downwardly in an arc about said root end and said bearing assembly moves upwardly along said support post, to change from said user-exercise position to said stow-away position, swinging said free end of said seat frame downwardly in an arc during said moving of said bearing assembly from said user-exercise position to said stow-away position, providing first and second handles at said free end of said seat frame, said first handle being user-engageable to swing said free end of said seat frame downwardly in an arc when said bearing assembly is moved from said user-exercise position to said stow-away position, said second handle being part of said user-engaged locking device and movable relative to said seat frame and operatively coupled to a movable locking pin to move said pin between locking and unlocking positions respectively preventing and permitting said movement of said bearing assembly along said support post between said user-exercise and stow-away positions, providing said second handle movable toward said first handle and in sufficient proximity thereto as to enable gripping of both said first and second handles with a single hand of the user, said method further comprising releasing said seat frame for movement to said stow-away position by gripping both said handles in a single hand and pulling said second handle toward said first handle.

* * * * *